US005964399A

United States Patent [19]

Ruben

[11] Patent Number: 5,964,399

[45] Date of Patent: Oct. 12, 1999

[54] RECLOSABLE FASTENER

[76] Inventor: Philip H. Ruben, 505 N. Arden Dr., Beverly Hills, Calif. 90210

[21] Appl. No.: 09/016,470

[22] Filed: Jan. 30, 1998

Related U.S. Application Data

[63] Continuation-in-part of application No. 08/643,259, May 3, 1996, abandoned.

[51] Int. Cl.[6] ..... B65D 5/43; B65D 43/22

[52] U.S. Cl. ..... 229/102; 24/DIG. 11; 206/813; 229/123.1; 229/125.39; 383/66; 383/211

[58] Field of Search ..... 24/304, DIG. 11; 229/125.39, 102, 123.1; 428/41.8, 41.7; 383/66, 211; 206/813; 604/389, 390

[56] References Cited

U.S. PATENT DOCUMENTS

| | | | |
|---|---|---|---|
| 2,400,406 | 5/1946 | Godoy | 383/211 |
| 3,076,588 | 2/1963 | Conway et al. | 229/123.1 |
| 3,504,844 | 4/1970 | Stark et al. | 229/125.39 |
| 4,020,842 | 5/1977 | Richman et al. | 604/389 |
| 4,071,186 | 1/1978 | Ruda | 383/211 |
| 4,741,935 | 5/1988 | Sheehan, Jr. | 229/123.1 |
| 5,035,518 | 7/1991 | McClintock | 229/123.1 |
| 5,054,618 | 10/1991 | Kim | 229/125.39 |
| 5,108,194 | 4/1992 | Raden | 383/66 |
| 5,465,900 | 11/1995 | Baratto et al. | 229/123.1 |
| 5,503,325 | 4/1996 | Nelson et al. | 229/125.39 |

*Primary Examiner*—Stephen P. Garbe
*Attorney, Agent, or Firm*—Paul J. Sutton

[57] ABSTRACT

A reclosable fastener having first members on a first side of the separation of an envelope, package, box or the like caused by the removal of a tear strip. In a first embodiment, a base is connected by a tether to a movable element. A similar base is placed on the other side. When the movable element is caused to engage the second base the tether acts to seal the separation. In a second embodiment, individual non-connected bases are set transverse to the separation. A series of locking members joined to form a band are connected to the other side of the separation by adhesive materials. The band is positioned across the separation to close it and the locking members are joined to the non-connected bases. As many non-connected bases and locking members as needed to close a particular separation can be used.

16 Claims, 12 Drawing Sheets

RECLOSABLE FASTENER

RELATED APPLICATION

This application is a continuation-in-part of U.S. patent application Ser. No. 08/643,259 filed May 3, 1996, now abandoned.

BACKGROUND OF THE INVENTION

1. Field of the Invention

This invention pertains to fastening devices which can be repeatedly opened and closed and more particularly a closure for envelopes, packages, boxes or the like which are opened by removing a tear strip and which cannot be sealed without introducing an external media.

2. Description of the Prior Art

The most usual way of resealing an envelope, package, box or the like which is opened by means of a tear strip which leaves a separation between the otherwise continuous materials, includes the use of one or more strips of tape placed in parallel with or perpendicular to the separation. An envelope can be placed inside of another envelope and the package or box could have a cord fastened about the package or box. The envelope, package or box could be wrapped in brown paper, plastic, etc. and that sealed with tape or string. Each of the approaches requires an external media such as tape, string, wrapping paper or the like.

SUMMARY OF THE INVENTION

The present invention overcomes the difficulties noted above with respect to the prior art. Devices disclosed herein may be attached to the envelope, package, box or the like (hereafter "container") before such container is opened or after the container has been opened. One device can retain its spanning member in the open position and is moved to the operative position only after the container has been opened.

In a first form of the device disclosed herein there is a first member placed upon the envelope to one side of the separation to be created by the removal of the tear strip. A second member is placed on the other side of the separation. A movable member is able to engage either the first or second member. A flexible tether is connected between the movable member and the first member. When the movable member engages the first member, the tether is retained to one side of the separation. Moving the movable member to the second member causes the flexible tether to extend across the separation to close it. These sealing devices may be installed at one or a number of discrete locations or made to form continuous webs along the entire separation and can be installed either before or after the container is opened.

Another form of the device disclosed herein may be installed before or after the container is opened and can be fixed in length according to the type of container it is used on. A number of separate, discrete first members are arranged in a line. The number used will depend upon the width of the separation. The first members are arranged perpendicular to the length of the separation to a first side of the separation. A base is located on the opposite side of the separation and coupled to it, by a flexible joint, is a band of second members, each of which can be mated to any of the first members available. The second members are formed with a tab facing outwardly from one side and a tab receiving slot on the other side so that second members can be joined to one another to form a separable band or chain. The last second member in the band has a recess at one side and a pull tab at its free end. Only the needed number of first members are placed on the first side of the separation, and then, one or more second members can be removed from the band and the pull tab second member attached as the last member of the band of second members.

Again, a single row of second and cooperating first members can be arranged in the center of the envelope or at two or more locations adjacent the separation or made wide enough that said second members contact said first members along substantially the entire separation.

The first and second members are all formed of flexible, resilient materials so that the interlocking member arms can be deflected during assembly or disassembly and still return to their original positions. The first members installed directly upon the item, have upstanding arms with outwardly, downwardly directed lobes. The second members which are free to move to complete the seal have upstanding arms with inwardly, downwardly directed lobes. The movement of the second members with respect to the first members, adhered to the container, causes the arms of the first member to approach one another while the arms of the second member to separate further until the lobes of both members no longer engage one another, at which time the arms return to their initial position interlocking said first and second members.

As an alternative to the use of interconnecting lobes on the arms of members to be connected, layers of temporary pressure-sensitive adhesive can be used to join the gap bridging elements. It is an object of the invention to provide a novel reclosable fastener.

It is an object of the invention to provide a novel, reclosable fastener which can be used to seal a container, such as an envelope, package, box or the like, after the original seal has been removed and discarded.

It is still another object of the invention to provide a novel reclosable fastener which can be installed to a container before or after the container is opened.

It is yet another object of the invention to provide a reclosable fastener which can be made as long as necessary by removing unnecessary components.

It is still another object of the invention to provide a novel, reclosable fastener which when the fastener is not in use, retains its closure member at one side of the container separation until it is desired to use it.

Other objects and features of the invention will be pointed out in the following description and claims and illustrated in the accompanying drawings, which disclose, by way of example, the principles of the invention, and the best modes which are presently contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
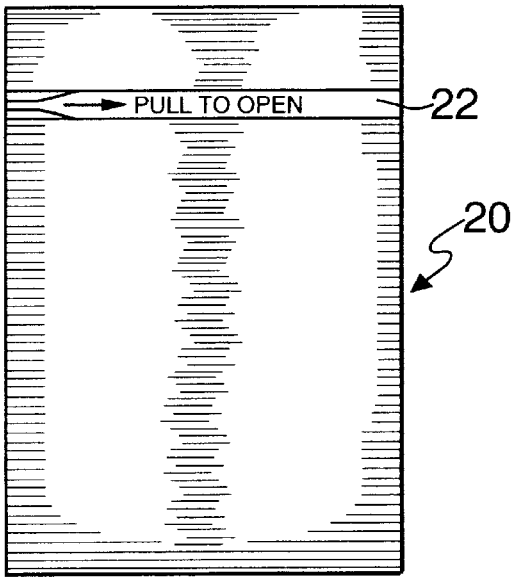
FIG. 1 PRIOR ART
FIG. 1 is a top plan view of a sealed envelope showing a tear strip employed to open such envelope as is known in the prior art.
Figure 2:
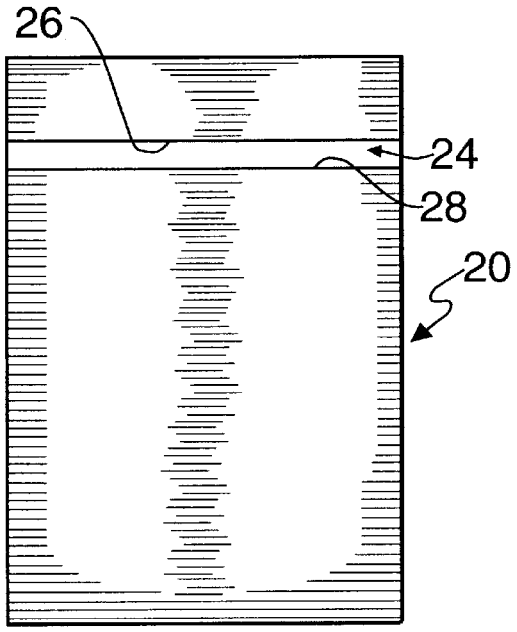
FIG. 2 PRIOR ART
FIG. 2 is the same as FIG. 1 except that the tear strip has been removed leaving a separation as is known in the prior art.
Figure 3:
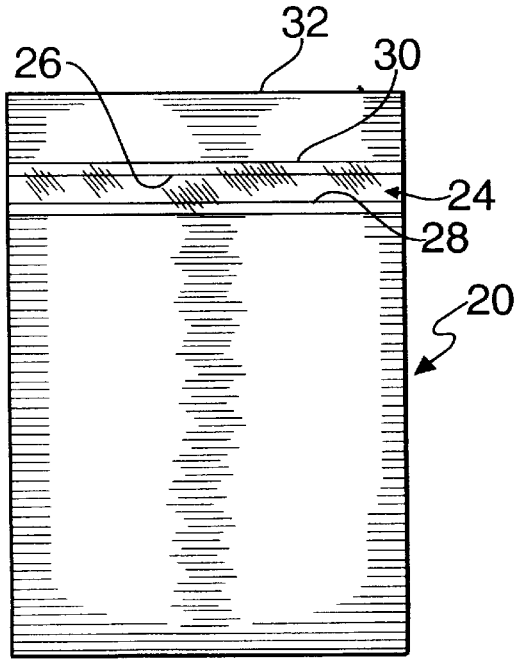
FIG. 3 PRIOR ART
FIG. 3 is the same of FIG. 2. except with a transparent tape strip added to close the separation as is known in the prior art.

Turning now to FIGS. 1 to 4, the problems of resealing an item such as an envelope, package, box or the like (hereinafter "container") which has been opened and the attempts made to overcome these problems. In FIG. 1, there is shown an envelope 20 which has been sealed and is opened by pulling the tear strip 22, resulting in a separation 24, defined by edges 26 and 28 (see FIG. 2). To seal envelope 20, transparent, adhesive type tapes can be employed. If such repair tape is wide enough it can cover the entire separation 24 and engage portions of the envelope 20 beyond edges 26 and 28. Such a tape 30 is shown in FIG. 3. If the repair tape is not wide enough, various overlapped strips can be used across the separation 24 until it is closed. Because the tape will also adhere to whatever is visible in separation 24, the later removal of these tape strips may be disastrous.

Figure 4:
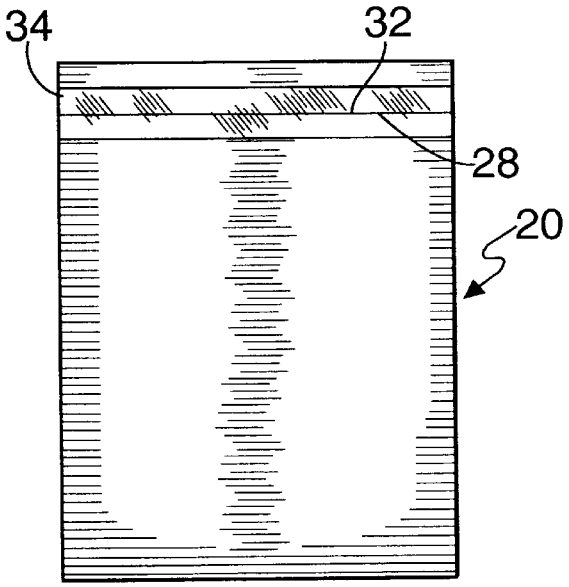
FIG. 4 PRIOR ART
FIG. 4 shows a top plan view of the envelope folded to place its top edge adjacent one edge of the separation with a strip of transparent tape added to seal the envelope as is known in the prior art.
Figure 5:
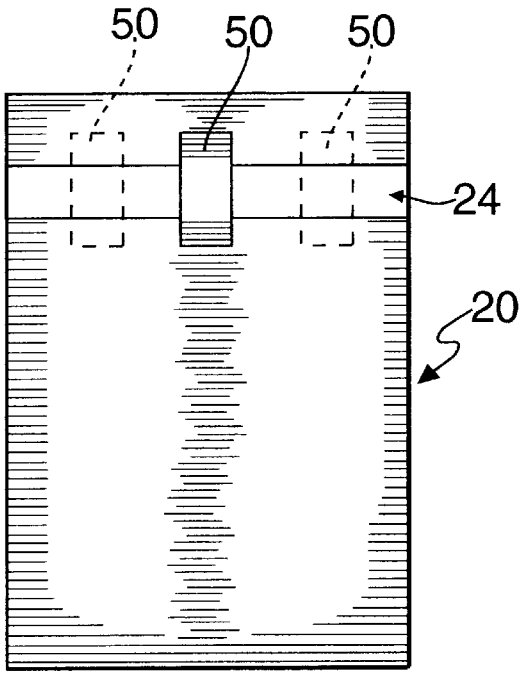
FIG. 5 is a top plan view of an envelope separation partially closed by one or more of a first form of disclosed reclosable fastener.
Figure 6:
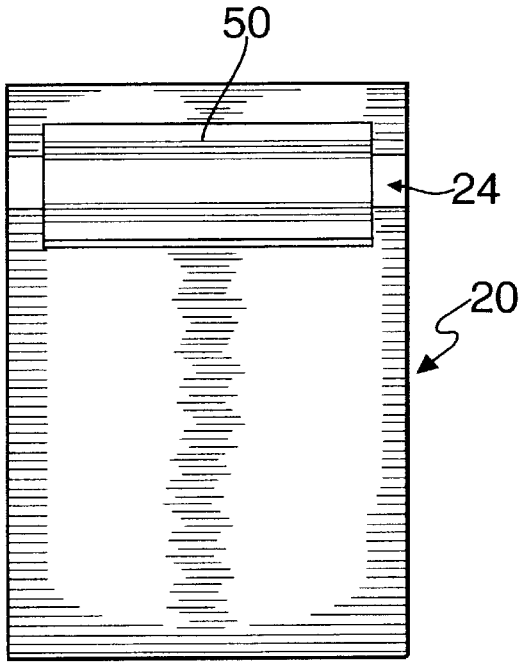
FIG. 6 is a top plan view of an envelope separation completely closed by an extended version of the device of FIG. 5.

If envelope 20 is sufficiently longer than the intended contents, the top portion of envelope 20 above edge 26 can be folded down so that the top edge 32 abuts edge 28 at which time a tape strip 34 can be used to seal the envelope 20 as shown by FIG. 4.

Referring to FIGS. 7 to 12 a first form of reclosable fastener 36 is shown. A receiver 38 is positioned along one side of a separation or gap 40 which may be the gap between the adjacent edges of box flaps 42, 44. A layer of permanent adhesive 46 is placed on the bottom surface 48 of receiver 38 to cement said receiver 38 to one side of gap 40 between box flaps 42, 44. A layer of temporary pressure-sensitive adhesive 50 is placed on the top surface 52 of receiver 38 and its exposed surface is covered over and protected by a release sheet 54 (shown in FIG. 12 in its withdrawn position to expose the pressure-sensitive adhesive 50). A latch 56 has a bottom surface 58 and a top surface 60. The layer of permanent adhesive 46 is also placed on bottom surface 58 so that latch 56 can be positioned along the other side of a separation or gap 40 and adjacent the receiver 38. The latch 56 and the receiver 38 are fabricated from flexible and resilient materials such as nylon, rubber or the like.

Figure 12:
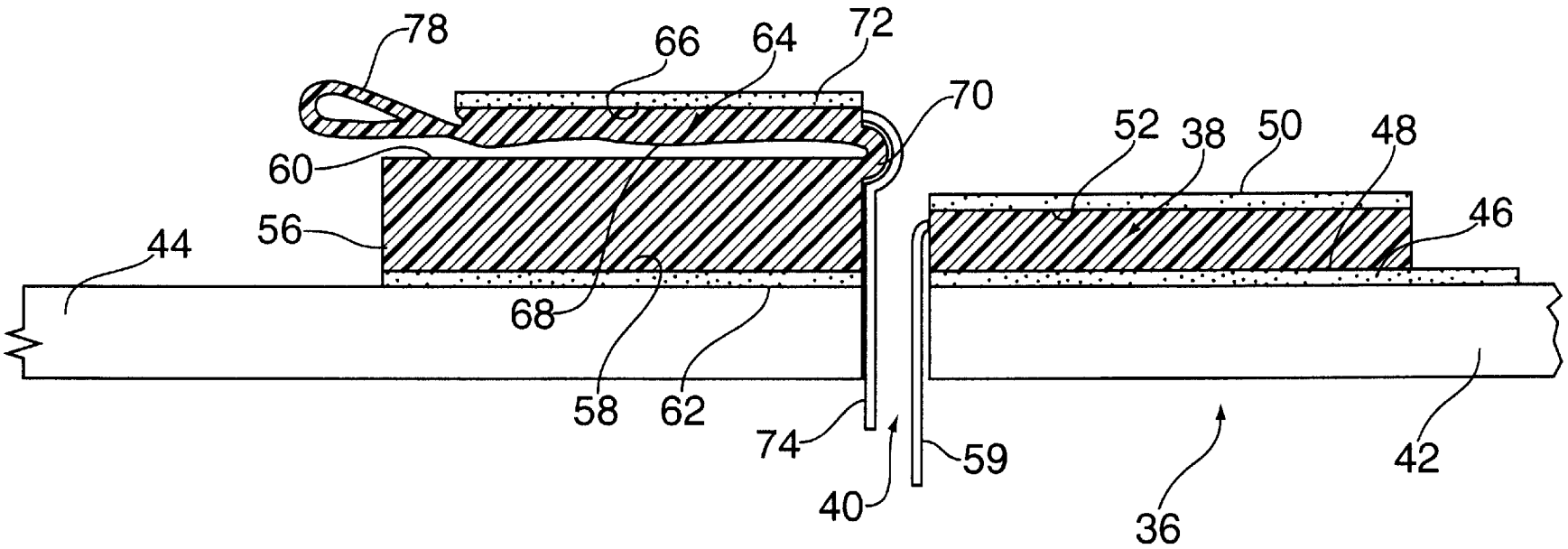
FIG. 12 is a side elevational view, partly in section, of the device of FIG. 7 in the open position, prior to use.

A latch member 64 having a top surface 66 and a bottom surface 68 is joined to latch 56 by means of hinge 70. A layer 72 of temporary pressure sensitive adhesive is placed on latch member top surface 66. The hinge 70 permits the separation or gap 40 to be bridged closing such separation or gap. The positions of the receiver 38 and the latch 56 are so chosen that the full length and width of the temporary pressure-sensitive adhesives layers 50 and 72 fully engage. It has been found that the two layers of pressure-sensitive adhesive combined provide more holding power than a single layer, but do not permanently bond and are separable. A release sheet 74 is attached to the latch 56 at its end adjacent gap 40. The release sheet 74 is removed from the surface of pressure sensitive adhesive layer to expose such adhesive and is moved between the box lids 42, 44 in gap 40 for use as shown in FIG. 12. With this arrangement, when the latch member 64 is separated from receiver 38 the release sheets 54 and 74 can be withdrawn from gap 40 and reinstalled over the pressure-sensitive adhesive layers 50 and 72, respectively, permitting reuse of layers 50 and 72.

The height of the latch 56 without the latch member 64 in place is about the same height of the receiver 38 with the latch member 64 in place. This provides a generally smooth transition between the two components and minimizes possible damage to the components.

Figure 7:
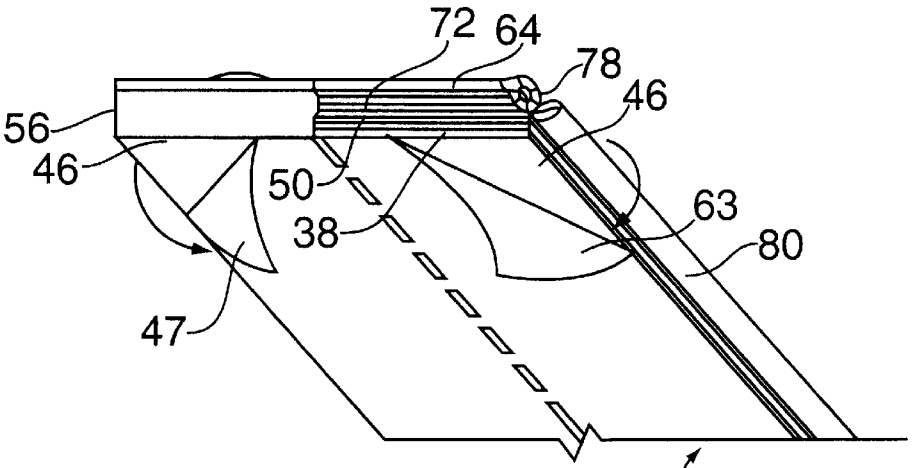
FIG. 7 is a bottom right perspective view of a first embodiment of a device according to the concepts of the invention.
Figure 8:
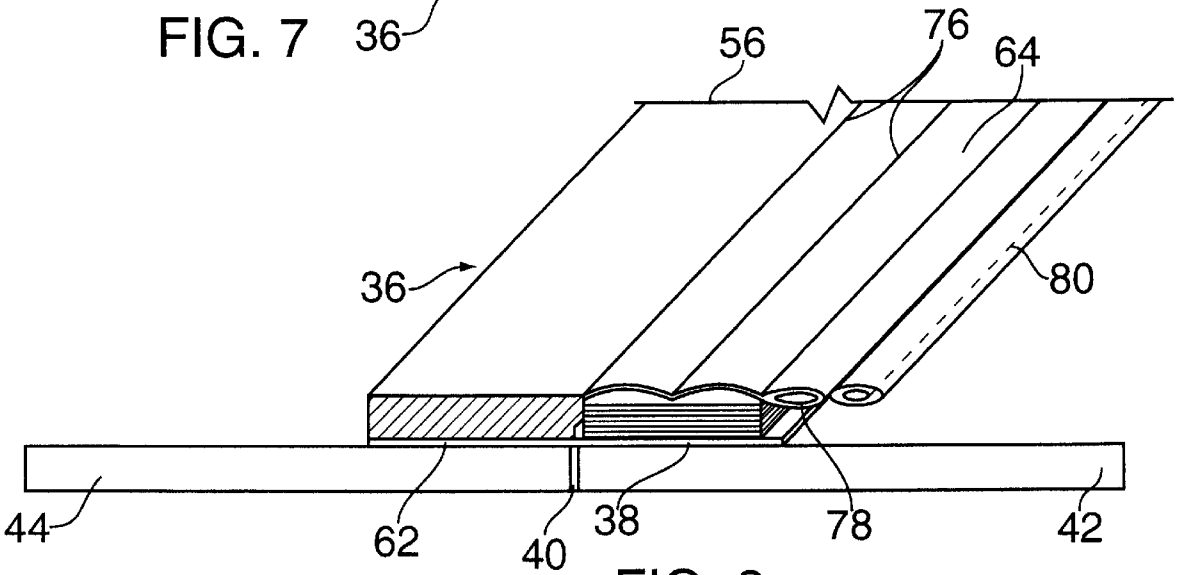
FIG. 8 is a top right perspective view of the device of FIG. 7.

The bottom surface 68 (when viewed in FIGS. 9 and 12) of latch member 64 has a series of depressions 76 along its width (see FIG. 8) to provide extra flexibility for the latch member 64. A pull tab 78 is formed on the end of latch member 64 remote from gap 40. This pull tab 78 can be used to aid in the assembly and disassembly of the latch member 64 with respect to the receiver 38. The initial condition of the reclosable fastener 36 is as shown in FIG. 8. A security device 80 is shown in FIGS. 7 and 8. The security device 80 must be removed in order to grip the pull tab 78 and operate the reclosable fastener 36. Also, the removal of the security device 80 immediately indicates that the reclosable fastener 36 has been used. A color can be added to the pull tab 78 to make it stand out from the remainder of latch member 64. One form of security device 80 is a strip 82 (see FIG. 10), having a pressure sensitive adhesive layer 84. Strip 82 fastens at one end to receiver 38 and after passing over the pull tab 78 is fastened to latch member 64. With strip 82 removed the pull tab 78 is visible and accessible. A second form of security device is a spring-like metal clip 86 shown in FIG. 11. One end of the clip 86 engages the release layer 47 of the receiver 38 and the second end engages the latch member 64. The clip 86 body is formed to permit it to pass about the pull tab 78.

Figure 9:
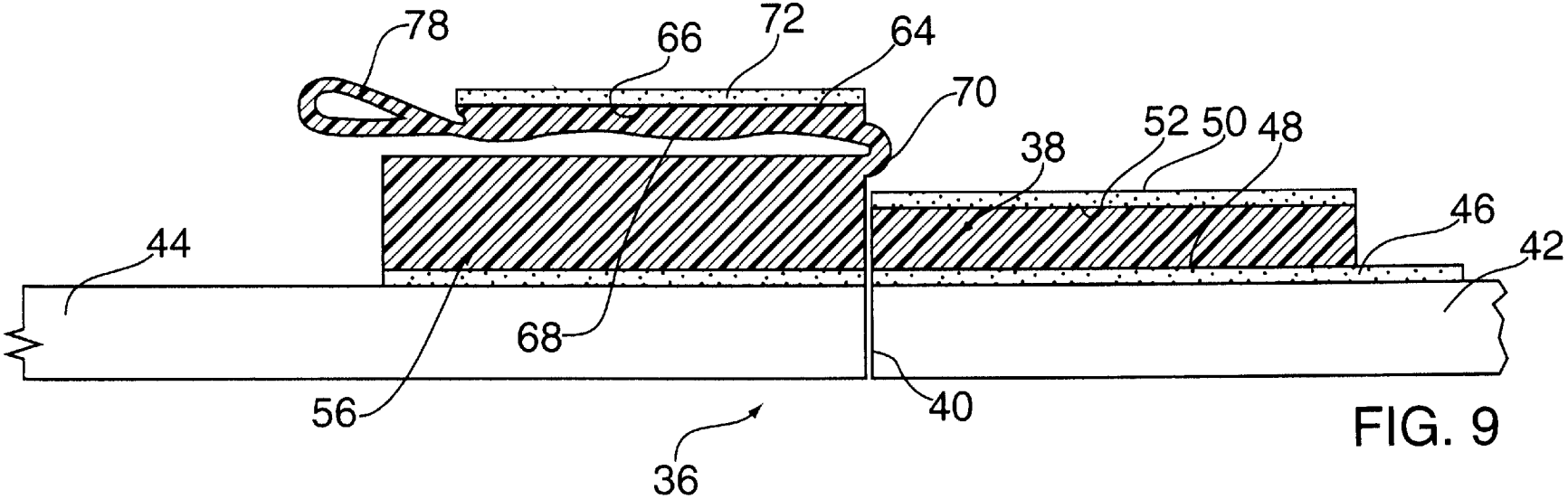
FIG. 9 is a side elevational view, partly in section of the device of FIG. 7 in the open position.
Figure 11:
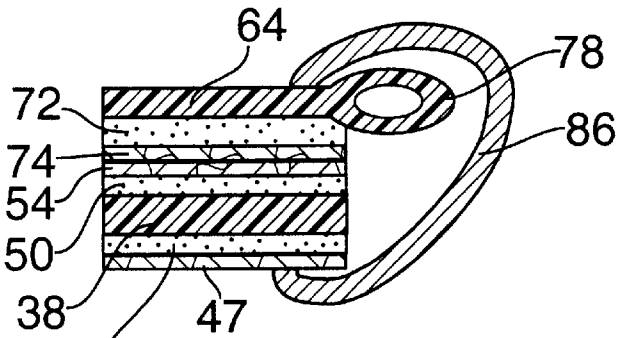
FIG. 11 is a fragmentary side elevational view of a security clip employed with the device of FIG. 7.
Figure 10:
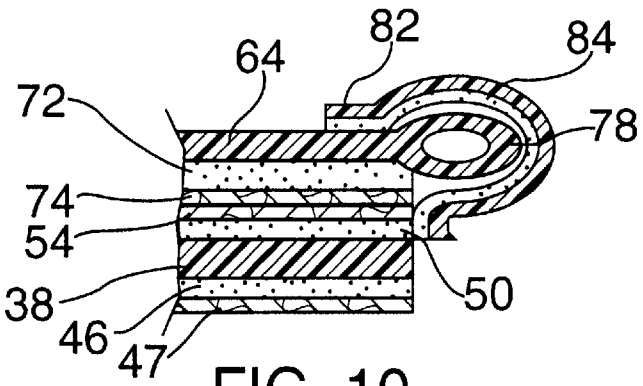
FIG. 10 is a fragmentary side elevational view of a security strip employed with the device of FIG. 7.
Figure 24:
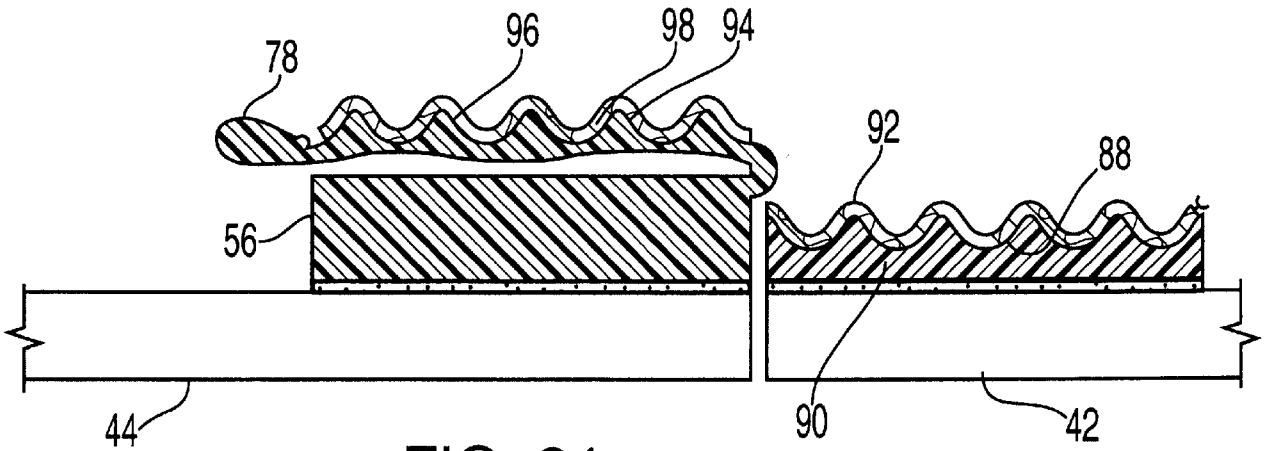
FIG. 24 is a side elevational view, partly in section, of an alternative form of adhesive interlock for a bridging member.
Figure 25:
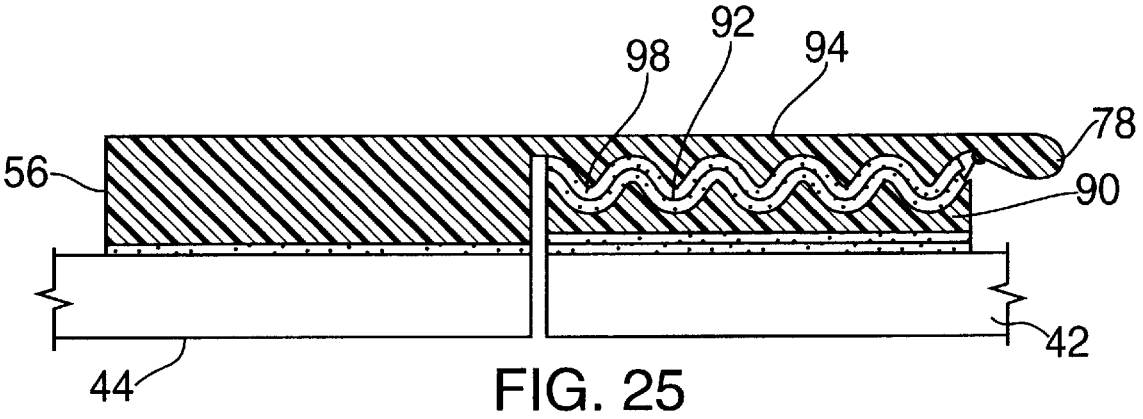
FIG. 25 is a side elevational view, partly in section, showing the device of FIG. 24 in its closed, bridging position.

The top surfaces 52 and 66 of receiver 38 and latch member 64, respectively, do not have to be flat as shown in FIG. 9 but may be undulating as shown in FIGS. 24 and 25. The top surface 88 of receiver 90 has an undulating pattern which is covered by a pressure-sensitive adhesive layer 92. The latch member 94 also has an undulating top surface 96 covered by a further layer of pressure-sensitive adhesive 98. The effect of the undulating surfaces 88 and 96 is to lengthen the path from one end of the surface to the other thereby accepting more pressure-sensitive material to give a stronger holding power or to permit shorter components to be used as receiver 90 and latch member 94.

Figure 14:
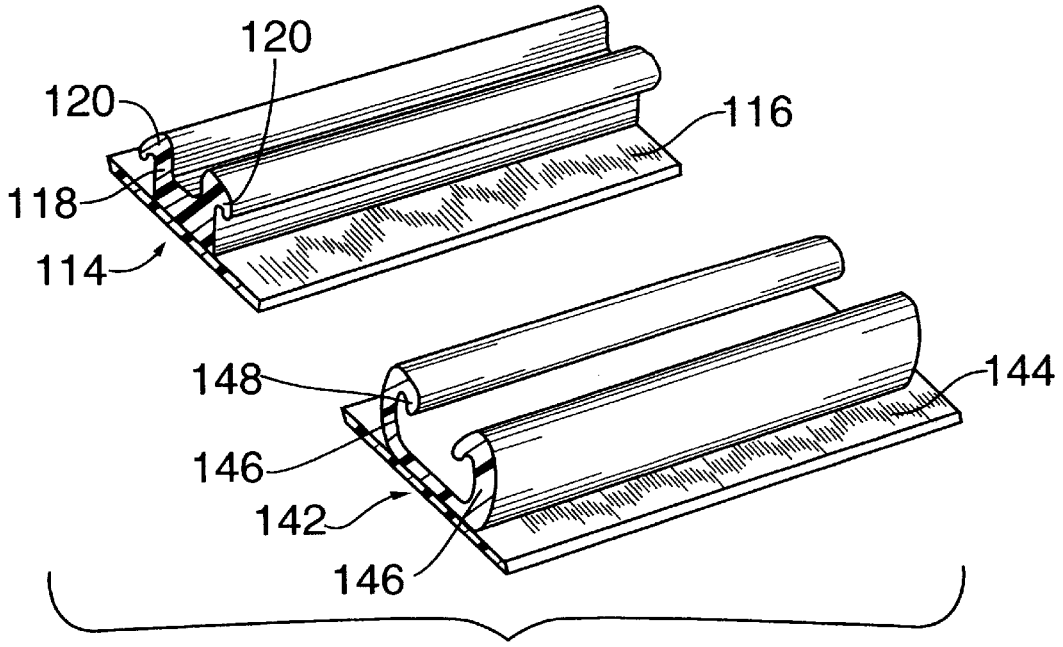
FIG. 14 is a front, right perspective view of the locking elements of the device of FIG. 13.
Figure 13:
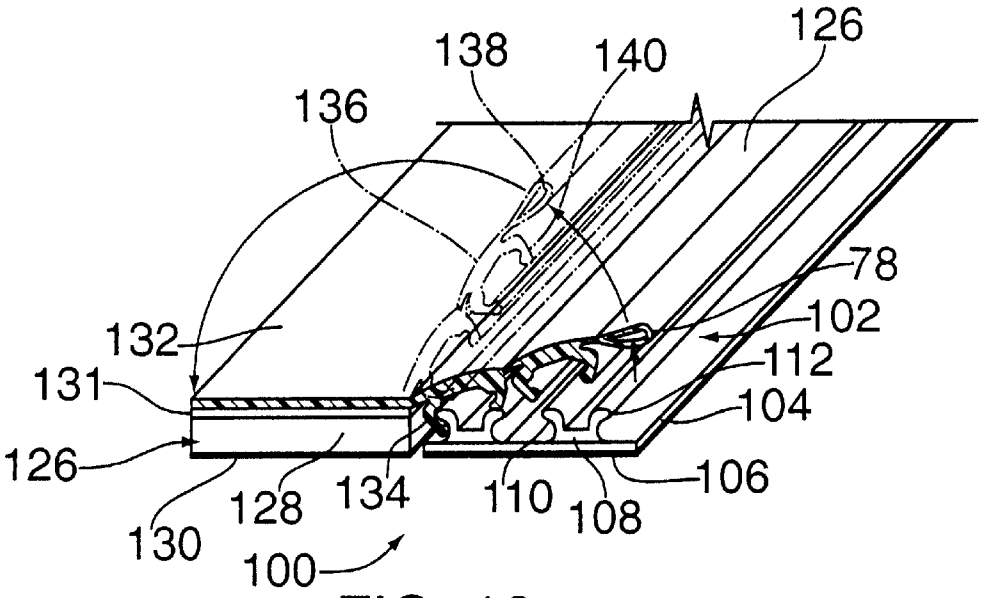
FIG. 13 is a front right perspective view of another device constructed in accordance with the concept of the invention.
Figure 15:
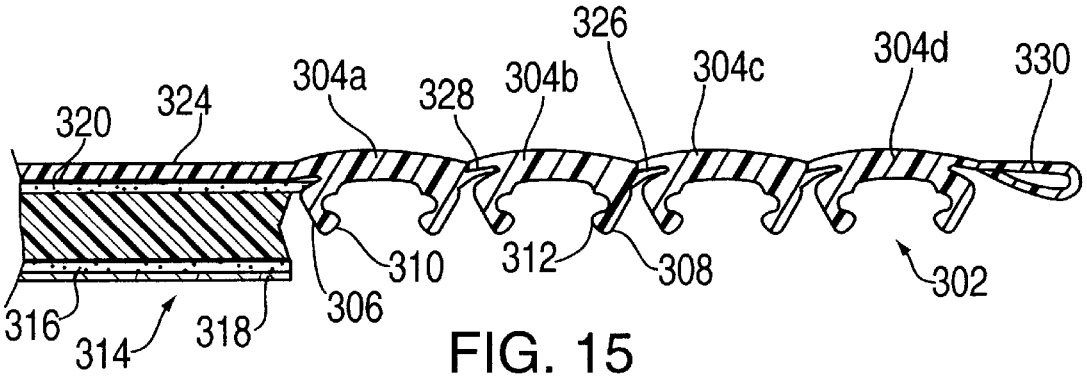
FIGS. 15 and 16 are side elevational views, partially in section, of the component parts of a further embodiment of a device according to the concepts of the invention.
Figure 16:
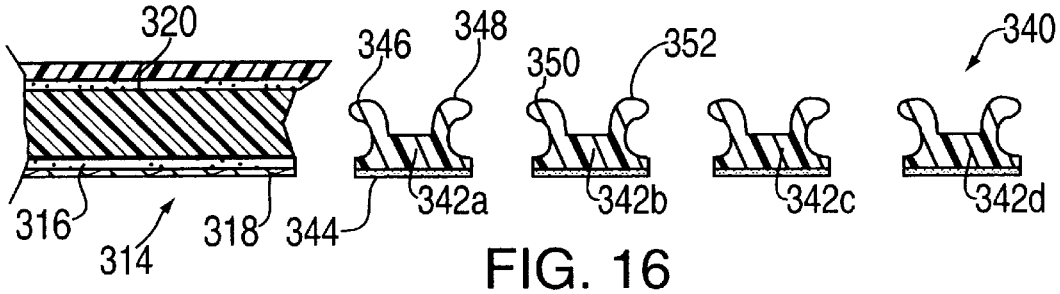
Figure 17:
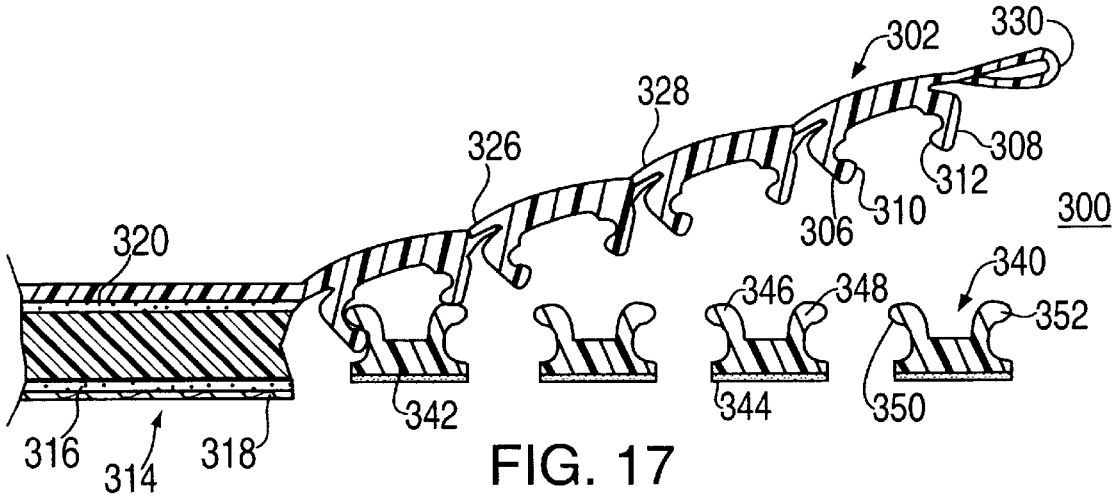
FIG. 17 is a side elevational view, partly in section, of the components of FIGS. 15 and 16 prior to assembly.

As an alternative arrangement to those employing layers of pressure-sensitive adhesive, the fastening mechanism may make use of interlocking members to hold the bridging member in a bridging position across a gap or in the non-bridging position adjacent such gap and which can be made to selectively bridge said gap. A first form of such a reclosable fastener is shown in FIGS. 13 and 14. Receiver 102 has a base 104 the underside of which is coated with a permanent adhesive layer 106. Formed on base 104 are a series of generally U-shaped channels 108, each having two upstanding arms 110, each arm terminating in an outwardly directed lobe 112. Although two U-shaped channels 108 are shown, the number employed may be increased or decreased. In addition to forming the channels 108 directly on a base 104, the U-shaped channels 114 can be individually formed on separate bases 116 (see FIG. 14) and then fastened to a common base 104 as by the use of adhesives, bonding agents, sonic welding or the like. The upstanding arms 118 each terminate in an outwardly directed lobe 120.

The latch member 126 is formed of a generally rectangular base 128 which can be adhered to a portion of the container by means of a layer of permanent adhesive 130. Attached to base 128 by a layer of permanent adhesive 131 is the mounting body portion 132 of latch member 126 which also includes U-shaped channels 136 whose upstanding arms 138 terminate in inwardly directed lobes 140. The interengagement of the outwardly directed lobes 112 of U-shaped channel 108 with the inwardly directed lobes 140 lock receiver 102 to latch member 126. The U-shaped channels 136 can be formed together with the mounting portion 132, as shown in FIG. 13 or can be formed separately as shown in FIG. 14 and connected together and with the mounting portion 132. The U-shaped channels 142 may be formed on separate bases 144 which can be joined. Each channel 142 has two upstanding arms 146 having inwardly directed lobes 148. The mounting body portion 132 is joined to the remainder of latch member 126 by means of a hasp hinge 134.

Figure 19:
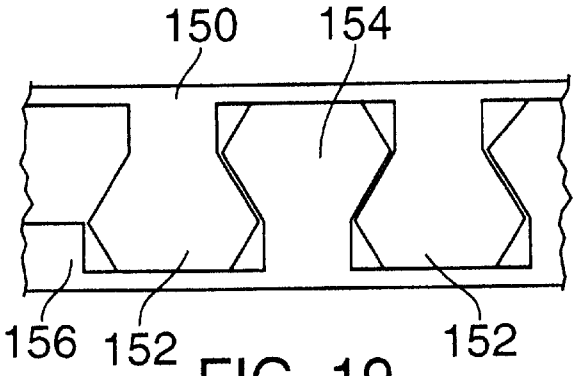
FIG. 19 is a fragmentary side elevational view of a further embodiment according to the invention.
Figure 20:
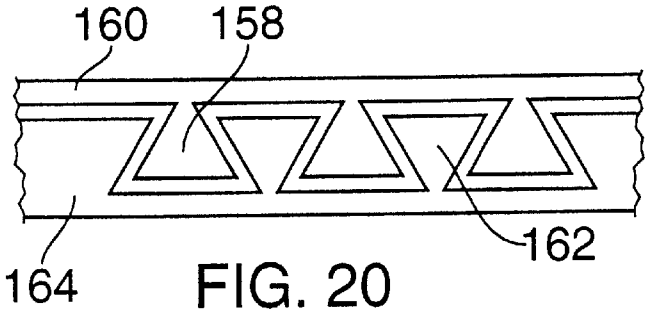
FIG. 20 is a fragmentary side elevational view of yet a further embodiment according to the invention.

It should be noted that the hasp hinge 134 limits the movement of the latch member 126 towards the mounting portion 132 to prevent damage to the hasp hinge 134 or separation of the latch member 126 from the receiver 102. The complementary shapes of the U-shaped channels with inwardly and outwardly directed lobes is shown for ease of explanation. The upstanding arms 152 of a latch member 150 could terminate in any regular geometrical shape such as the hexagonal shape shown in FIG. 19. The upstanding arms 154 of receiver 156 are also hexagonal in shape. The interlocking places certain of the plane faces of one set of upstanding arms between the upstanding arms of the other. The interlocking could also be achieved by triangular upstanding arms 158 of the latch member 160 engaging triangular shaped upstanding arms 162 of the receiver 164 as shown in FIG. 20.

A variation of the latch member 126 of FIG. 13 is shown in FIGS. 15 to 18. Instead of one common base for all the U-shaped channels which are provided, a latch member 302 is provided by a number of individual segments 304 fastened to adjacent segments by means of a tab 326 and a socket 328. A first segment 304*a* is formed as a part of mounting plate 324 which is adhered by a layer of adhesive 320 to the latch body member 314 (see FIG. 15). A layer of adhesive 316 is employed to mount latch body member 314 on a container adjacent one side of a gap 40. Release layer 318 protects the adhesive 316 prior to installation of latch body member 314. The mounting plate 324 is thinner than the thickness of the base of the U-shaped channel 304*a* providing a living hinge between the U-shaped channel 304*a* and mounting plate 324. The final U-shaped segment 304*d* omits the tab 326 and includes a pull tab 330. The intermediate segments 304*b* and 304*c* each have a socket 328 formed in a first portion of their bases and a tab 326 formed on a second portion of their bases. The socket 328 of segment 304*b* is made to engage tab 326 of segment 304*a* at one side and its tab 326 is mated with socket 328 of the segment 304*c* at a second side. The tab 326 of segment 304*c* engages socket 328 of segment 304*d*. It should be understood that four segments are shown only as an example and more or fewer segments 304 can be employed. Also if desired the segment 304*d* with pull tab 330 can be omitted. Each of the U-shaped segments have downwardly projecting arms 306, 308 which each terminate in inwardly directed lobes 310, 312, respectively.

Figure 18:
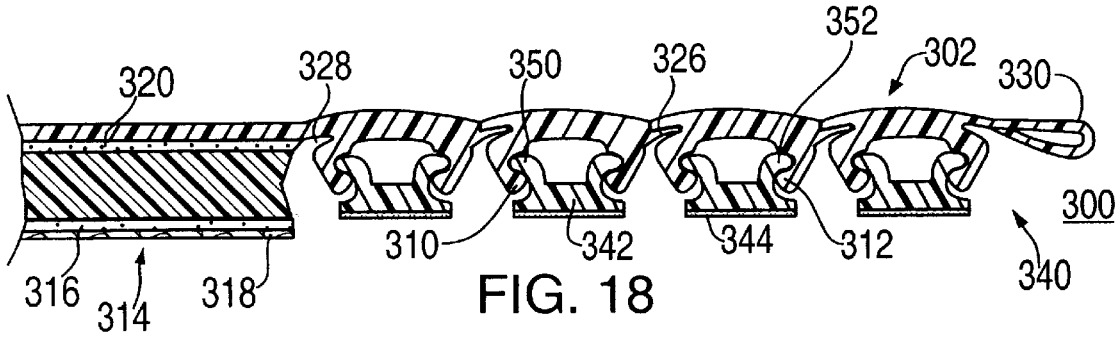
FIG. 18 is a side elevational view, partly in section, of the components of FIGS. 15 and 16 as assembled.

The receiver 340 (see FIG. 16) is made up of a plurality of identical U-shaped units 342*a* to *d*. Each unit 342 has a base portion with an adhesive layer 344 for adhering one or more units 342 to one side of a gap 40 opposite the latch member body 314. The number of units 342 can be the same as segments 304 or fewer or more units 342 may be employed. Each of the U-shaped units 342 include two upstanding arms 346, 348 terminating in outwardly directed lobes 350, 352, respectively. To join the latch member 302 to the receiver 340, the lobes 310, 312 must engage the associated lobes 350, 352, respectively, as shown in FIG. 18 to complete the closure of reclosable fastener 300. In that the latch body member 314, the segments 304 and the units 342 are fabricated of resilient material, the arms 306, 308 and 346, 348 are free to flex as the inwardly directed lobes 310, 312 and the outwardly directed lobes 350, 352 are made to engage and to return to their original conditions once the lobes 350, 352 are in place. The individual units 342*a* to 342*d* may be set in place on the container (not shown) individually or the units 342 can be made to engage their corresponding segments 304 and the movement of the latch member 302 used to set the position of the units 304 to exactly match the positions of the corresponding segments 304.

Figure 21:
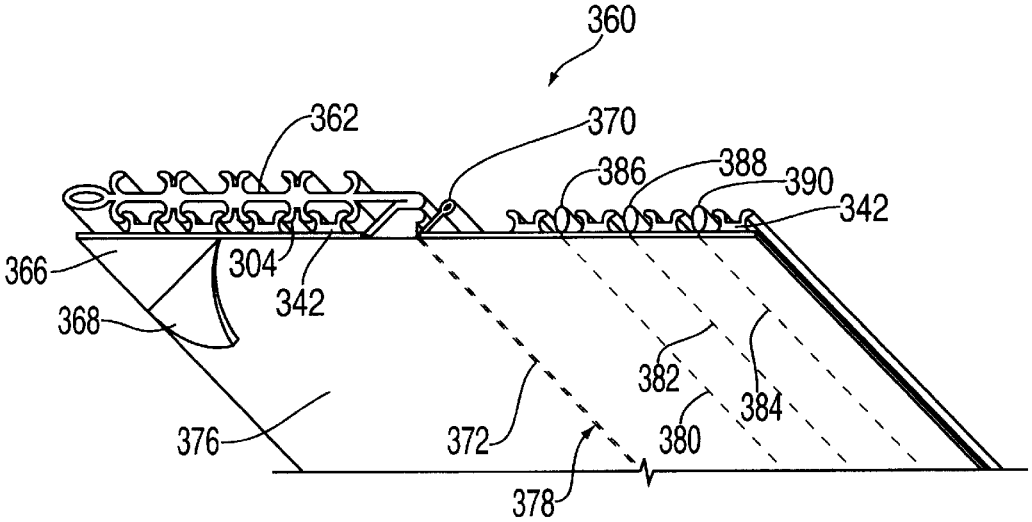
FIG. 21 is a bottom right perspective view of an additional device constructed in accordance with the concepts of the invention and shown in its open position.
Figure 22:
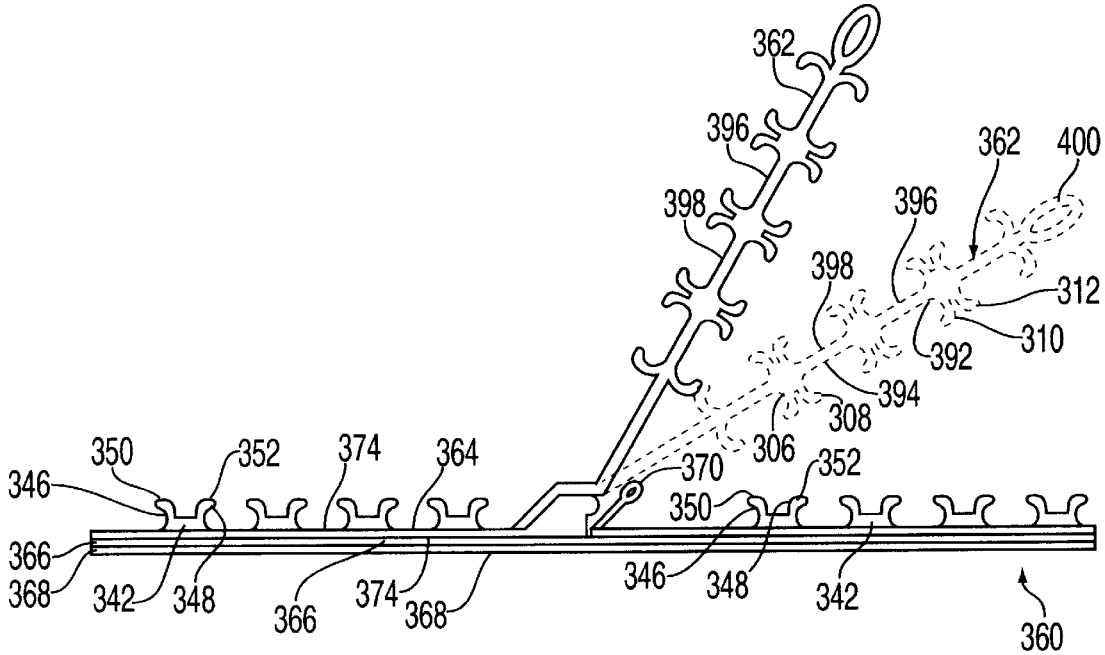
FIG. 22 is a side elevational view of a latch member shown in two positions as the latch member is removed from its retainer.
Figure 23:
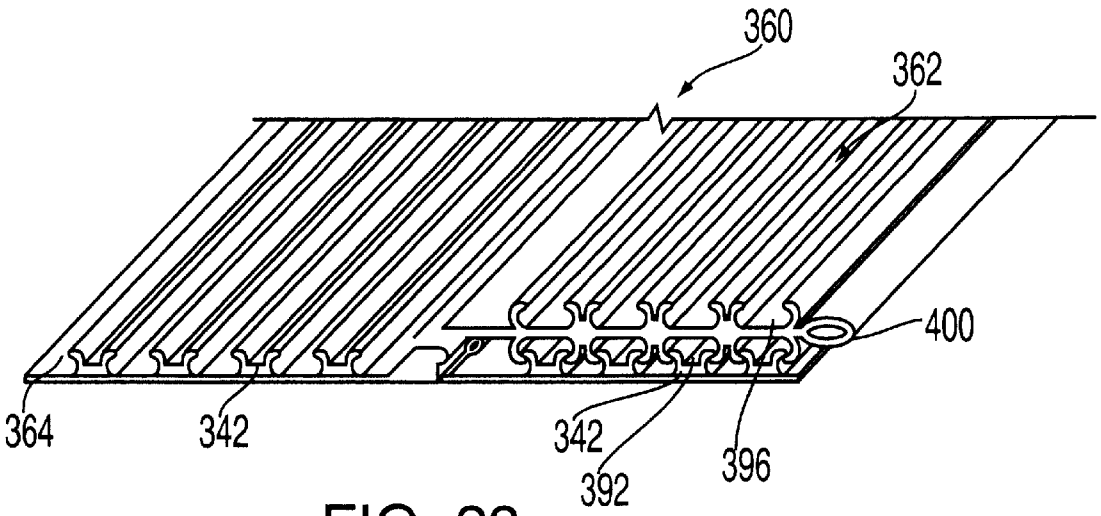
FIG. 23 is a front right perspective view of the device of FIGS. 21 and 22 shown in its closed or bridging position.

In the embodiments described thus far, the latch member is not restrained when not engaging a receiver. The latch member could be damaged, the hinge severed and the latch member lost. The reclosable fastener 360 of FIGS. 21, 22 and 23 provides for the receipt and holding of a latch member 362 when not engaged with a receiver. On a common base 364 there are placed a series of units 342. These units 342 are placed in a bridging region of reclosable fastener 360 and in an open region of reclosable fastener 360. The common base 364 may be welded, adhesively attached or otherwise coupled to the units 342. In this manner the positions of the units 342 are fixed with respect to one another. The underside of base 364 is covered with a permanent adhesive 366 protected by a release strip 368. The base 364 also has at least one pin 370 (see FIG. 22), which when pulled removes a portion of common base 364 to expose a number of slots 372 (see FIG. 21) which extend from a top surface 374 of base 364 to a bottom surface 376. By placing the slots 372 of one line 378 over the seam or gap 40 between container flaps 42, 44 the reclosable fastener 360 can be accurately set. The reclosable fastener 360 does not have to be centered over the gap 40 but may be offset by using one of the other lines 380, 382 or 384, opened by pulling pins 386, 388 or 390. The lines 372, 380, 382 and 384 can also be used as a cutting guide after the reclosable fastener 360 has been placed on a container.

The latch member 362 is a single molded part symmetrical about a longitudinal axis and generally symmetrical about a central transverse axis. Bridging elements 392 are placed on a bridging face 394 of latch member 362 and locking elements 396 are placed on a locking face 398 of latch member 362. The bridging elements 392 are the same as the segments 304 and interact with units 342 in the same way as segments 304 interact and lock with units 342. When the bridging face 394 is adjacent the common base 364 and the bridging elements 392 lockingly engage the locking elements 396 the gap 40 about which the reclosable fastener 360 is placed bridges the gap 40 holding the two box flaps 42, 44 together as shown in FIG. 23.

Once the bridging of the confronting edges of gap 40 is no longer necessary, the latch member 362 could be moved in a counter-clockwise direction as viewed in FIG. 23. The pull tab 400, as stated above, is usable when mating the bridging elements 392 with the units 342 or when separating such elements. The latch member 362 is mounted to the latch body member by a living hinge 402 which includes a loop 404 to permit adjustment of the positions of locking elements 396 with respect to the units 342. The loop 404 is lengthened or shortened as required to align the elements 396 with the units 342. The operation of the locking elements 396 with the units 342 is the same as described above. The locking or non-bridging position is shown in FIG. 21. FIG. 22 shows two positions of the latch member 362 between the locking and bridging portions, one in solid lines and the other in dashed line.

Figure 26:
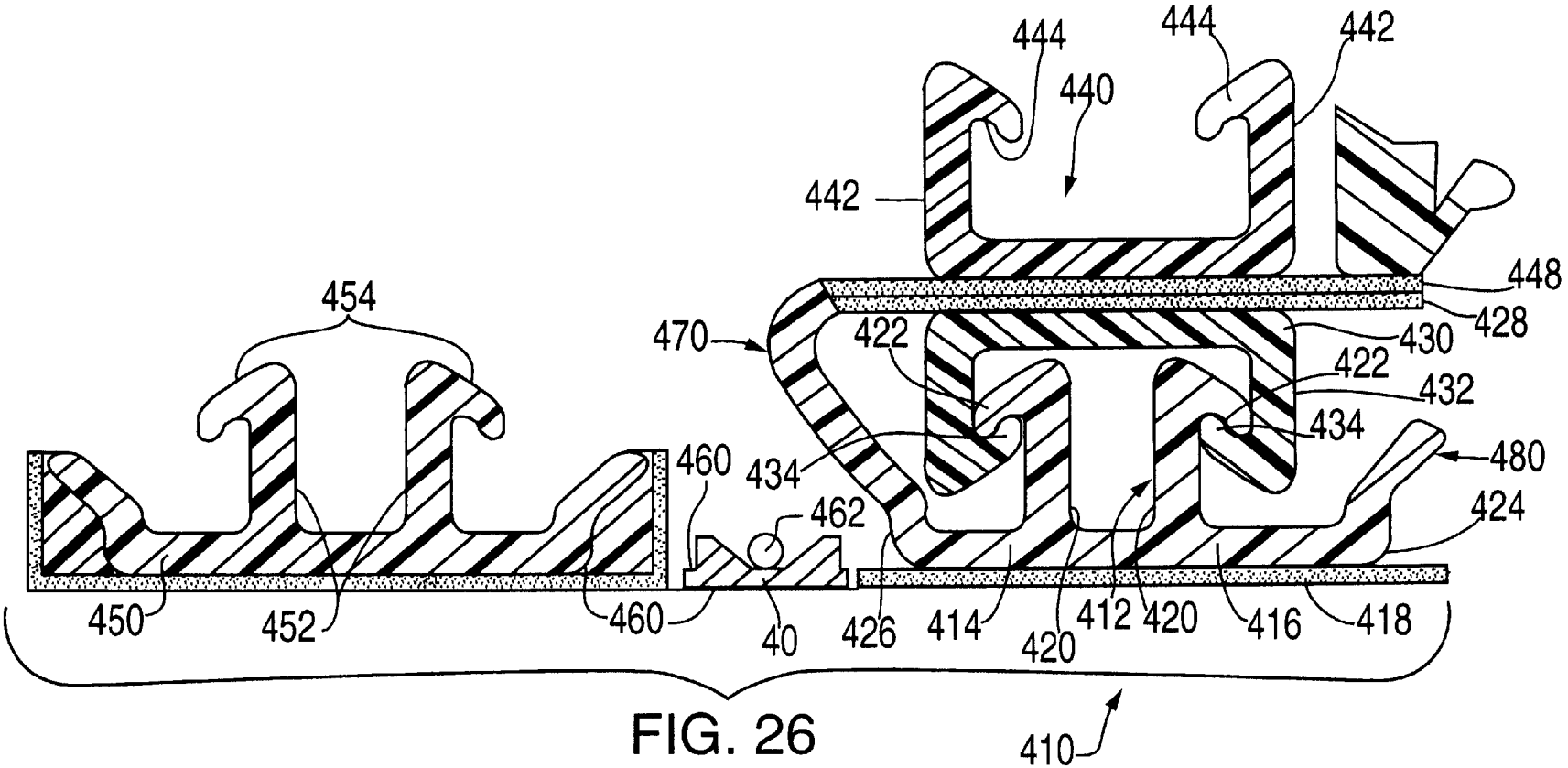
FIG. 26 is a side elevation, partially in section, of a further embodiment of the invention in its open, non-bridging position.
Figure 27:
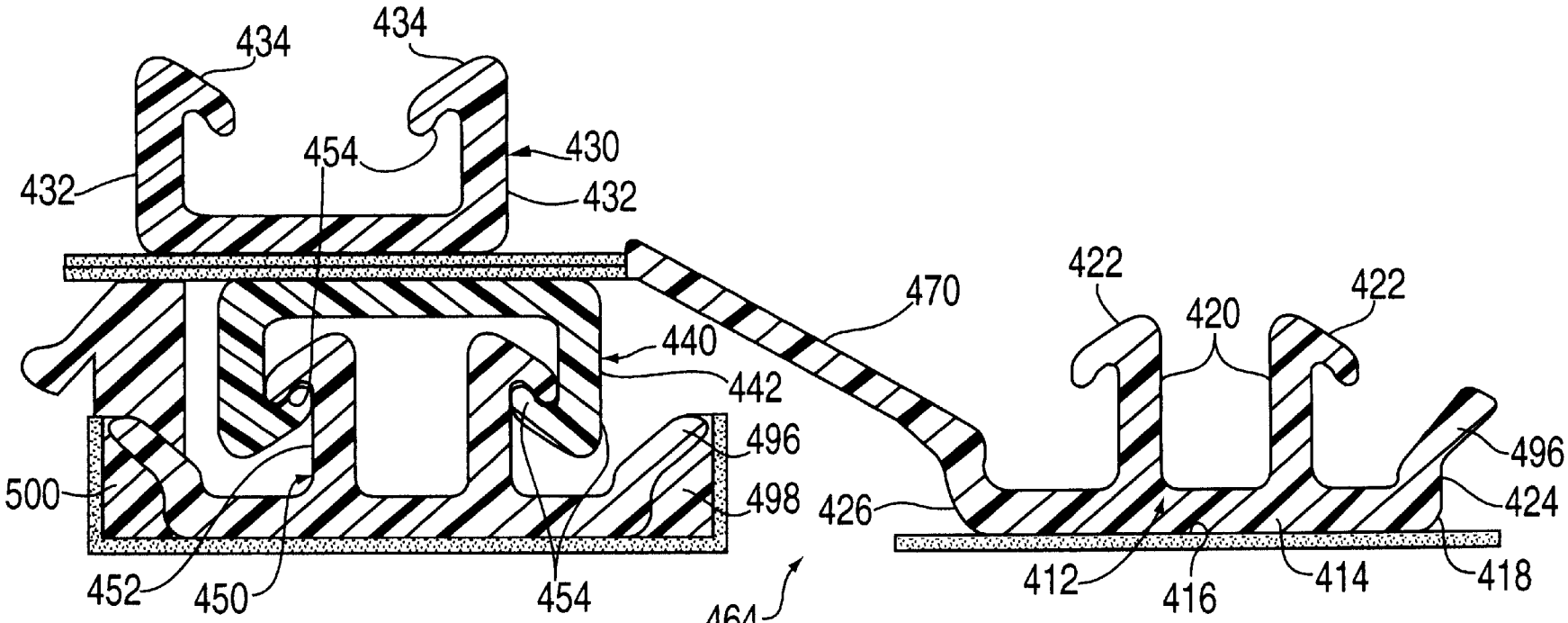
FIG. 27 is a side elevation, partially in section, of the device of FIG. 27 in its closed, bridging position.

Turning now to FIGS. 26 and 27, there is shown another form of reclosable fastener 410 making use of two sets of identical locking elements. A first U-shaped channel 412 has a body 414 with a bottom surface 416 upon which is placed a permanent adhesive 418 to anchor same adjacent to one edge of gap 40. The channel 412 has two upstanding arms 420 centrally located, each of which terminates in an outwardly directed lobe 422. An extension 496 adjacent end 424 permits the channel 412 to be supported in a frame as will be described below. A flexible tether 470 is coupled at a second end 426 and is used to fasten the U-shaped channel 430, 440 to U-shaped channel 412, while giving them a certain range of movement. A second U-shaped channel 430 has a pair of downwardly facing arms 432 each of which terminates in an inwardly directed lobe 434. With the lobes 422 and 434 interlocked, as shown in FIG. 26, the tether 470 is held in its non-bridging position. A further U-shaped channel 440 is positioned over U-shaped channel 412 but without any engagement therebetween. However, the U-shaped channels 430 and 440 are joined to provide the same operations as the latch member 362 of FIGS. 21, 22 and 23. U-shaped channels 440 have upstanding arms 442 terminating in inwardly directed lobes 444 which can be made to mate with the outwardly directed lobes 454 of upstanding arms 452 of U-shaped channel 450 in the same fashion as U-shaped channels 412 and 430 (see FIG. 27).

Figure 28:
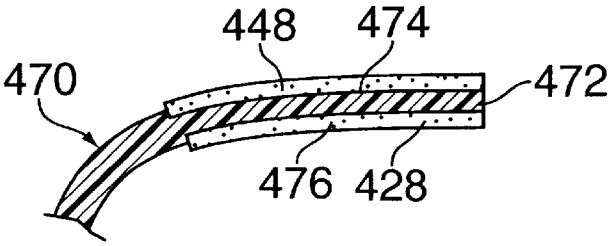
FIG. 28 is a fragmentary side elevational view, partly in section, of a flexible tether having pads of adhesives thereon.

Two layers of permanent adhesive may be used to join U-shaped channels 430 and 440. Adhesive layer 428 on U-shaped channel 430 is adhered to adhesive layer 448 of U-shaped channel 440 and both are bonded, glued, welded or otherwise coupled to the flexible tether 470. Alternatively, as shown in FIG. 28, the flexible tether 470 can be made with a thin extension 472 having two flat faces 474, 476. The first layer of adhesive 428 can be applied to flat face 476 and the second layer of adhesive 448 applied to flat face 474.

Figure 29:
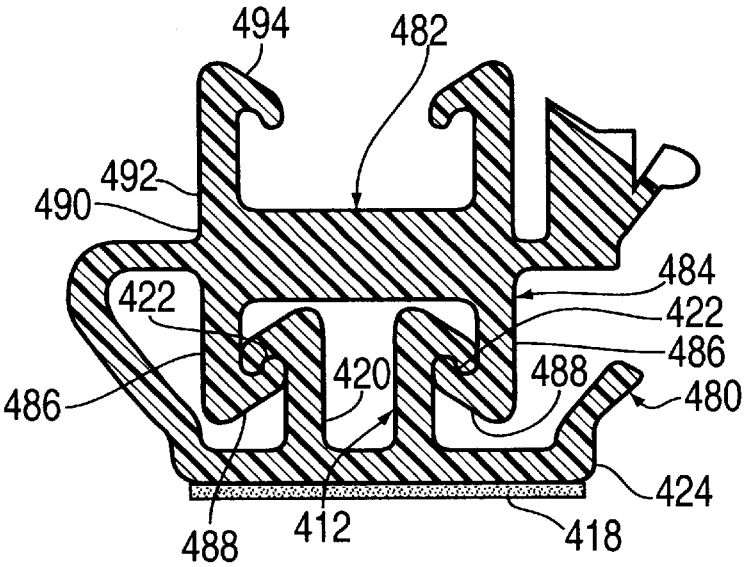
FIG. 29 is a front elevational view, partly in section, of an alternative form of latch member with attached fastening members.

The use of adhesive layers 428, 448 for U-shaped channels 430 and 440 can be replaced by fabrication of a single multi-U-shaped channel member 482 as shown in FIG. 29. U-shaped channel 484 is similar to U-shaped channel 430 and mates with U-shaped channel 412 as shown in FIG. 29. Channel member 484 has two downwardly extending arms 486 each terminating in an inwardly extending lobe 488. Similarly, U-shaped channel 490 is intended to mate with U-shaped channel 450 as is shown in FIG. 27. U-shaped channel 490 has two upstanding legs 492 with inwardly directed lobes 494.

Returning to FIGS. 26 and 27, the operation of the bridging device can be explained. Initially U-shaped channels 412 and 450 are placed adjacent a tear strip 460 having a pull tab 462 and the entire surface of the container is complete. The U-shaped channel 430 engages U-shaped channel 412 to hold the flexible tether 470 away from the tear strip 460 as is shown in FIG. 26. The pull tab 462 is operated to remove the tear strip 460 permitting access to the container contents. Once the tear strip 460 is removed an opening 464 is created through which the contents of the container may be removed or inserted. The U-shaped channel 430 is made to disengage from U-shaped channel 412 and to establish engagement between U-shaped channel 440 with U-shaped channel 450. This places the flexible tether 470 over the opening 464 to close the container and prevent access to the contents of the container.

An extension 496 extends from the U-shaped channel 412 on the side 424 remote from the tether 470. The extension 496 is supported by a block 498 while the lower portion of flexible tether 470 is supported by a block 500. Blocks 498, 500 prevent unwanted distortion of the U-shaped channel 450. Further, to support the U-shaped channels 430 and 440 when engaging the U-shaped channel 450 and provide a tab 504 to facilitate separation of U-shaped channel 440 from U-shaped channel 450 use is made of a block 502. Block 502 also limits the insertion of U-shaped channel 440 on U-shaped channel 450.

While there have been shown and described and pointed out the fundamental novel features of the invention as applied to the preferred embodiments, as are presently contemplated for carrying them out, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A reclosable container fastener for selectively bridging two portions of a container which form an opening in said container comprising:

a) an individually installed receiver having a receiver body member having a first surface and a second surface;

b) a first layer of permanent adhesive on said second surface of said receiver body member to couple said receiver body member to a first portion of said container adjacent a first side of said opening:;

c) a latch having a latch body member having a third surface and a fourth surface, a first end and a second end;

d) a second layer of permanent adhesive on said fourth surface of said latch body member to couple said latch body member to a second portion of said container adjacent a second side of said opening;

e) a latch member having a fifth surface and a sixth surface, a third end and a fourth end;

f) a hinge member having a thickness less than a thickness of said latch member joining said latch member third end to said latch body member first end to permit said latch member fifth surface to be moved towards and away from said latch body member third surface and towards and away from said receiver body member first surface;

g) a first pressure-sensitive adhesive layer at said receiver body member first surface; and h) a second pressure-sensitive adhesive layer at said latch member sixth surface, said first and second pressure-sensitive adhesive layers adapted to engage one another to hold said latch member in assembly with said receiver body member and bridging said two portions of a container that form said opening in said container.

2. A reclosable fastener for selectively bridging two portions of a container comprising:

a) a receiver having a receiver body member having a first surface and a second surface;

b) a first layer of permanent adhesive on said second surface of said receiver body member to couple said receiver body member to a first portion of said container;

c) a latch having a latch body member having a third surface and a fourth surface, a first end and a second end;

d) a second layer of permanent adhesive on said fourth surface of said latch body member to couple said latch body member to a second portion of said container;

e) a latch member having a fifth surface and a sixth surface, a third end and a fourth end;

f) a hinge member joining said latch member third end to said latch body member first end to permit said latch member fifth surface to be moved towards and away from said latch body member third surface and towards and away from said receiver body member first surface;

g) a first fastening member at said receiver body member first surface;

h) a second fastening member at said latch member sixth surface, said first and second fastening member adapted to engage one another to hold said latch member in assembly with said receiver body member and bridging two portions of a container;

i) said first and said second fastening member are each a layer of separable pressure-sensitive adhesives;

j. a first release layer overlying said first fastening member and having one end coupled to a fifth end of said receiver body member whereby said first release layer can be moved to expose the associated separable pressure-sensitive adhesive layer but not removed from said receiver body member; and k. a second release layer overlying said second fastening member and having one end coupled to said latch member third end whereby said second release layer can be moved to expose the associated separable pressure-sensitive adhesive layer but not removed from said latch member.

3. A reclosable fastener as defined in claim 2, wherein said first and second release layers are stored between said receiver body member and said latch body member when not covering the associated faces of said first and second fastening means.

4. A reclosable fastener for selectively bridging two portions of a container comprising:

a) a receiver having a receiver body member having a first surface and a second surface;

b) a first layer of permanent adhesive on said second surface of said receiver body member to couple said receiver body member to a first portion of said container;

c) a latch having a latch body member having a third surface and a fourth surface, a first end and a second end;

d) a second layer of permanent adhesive on said fourth surface of said latch body member to couple said latch body member to a second portion of said container;

e) a latch member having a fifth surface and a sixth surface, a third end and a fourth end;

f) a hinge member joining said latch member third end to said latch body member first end to permit said latch member fifth surface to be moved towards and away from said latch body member third surface and towards and away from said receiver body member first surface;

g) a first fastening member at said receiver body member first surface;

h) a second fastening member at said latch member sixth surface, said first and second fastening member adapted to engage one another to hold said latch member in assembly with said receiver body member and bridging two portions of a container;

i. a pull tab coupled to said fourth end of said latch member to be engaged by the hand of a user to move said latch member towards and away from said first surface of said receiver body member; and j. a removable member positioned over said pull tab to prevent contact with said pull tab while said removable member is in position.

5. A reclosable fastener, as defined in claim 4, wherein said removable member a pressure-sensitive tape covering said pull tab.

6. A reclosable fastener, as defined in claim 4, wherein said removable member is a clip covering said pull tab.

7. A reclosable fastener, as defined in claim 6, wherein said clip is made of plastic.

8. A reclosable fastener, as defined in claim 6, wherein said clip is made of metal.

9. A reclosable fastener, as defined in claim 1, wherein said receiver body member, said latch body member and said latch member are molded from plastic.

10. A reclosable fastener, as defined in claim 9, wherein said hinge member is a living hinge between said latch body member and said latch member.

11. A reclosable fastener for selectively bridging two portions of a container comprising:

a) a receiver having a receiver body member having a first surface and a second surface;

b) a first layer of permanent adhesive on said second surface of said receiver body member to couple said receiver body member to a first portion of said container;

c) a latch having a latch body member having a third surface and a fourth surface, a first end and a second end;

d) a second layer of permanent adhesive on said fourth surface of said latch body member to couple said latch body member to a second portion of said container;

e) a latch member having a fifth surface and a sixth surface, a third end and a fourth end;

f) a hinge member joining said latch member third end to said latch body member first end to permit said latch member fifth surface to be moved towards and away from said latch body member third surface and towards and away from said receiver body member first surface;

g) a first fastening member at said receiver body member first surface;

h) a second fastening member at said latch member sixth surface, said first and second fastening member adapted to engage one another to hold said latch member in assembly with said receiver body member and bridging two portions of a container, and i). said fifth surface of said latch member has a series of recesses extending transverse to a longitudinal axis extending between said third and fourth ends to reduce the thickness of said latch member at such recesses and permit said latch member to flex along said recesses.

12. A reclosable fastener, as defined in claim 1, wherein said receiver body member, said latch body member and said latch member are molded as a single unit.

13. A reclosable fastener, as defined in claim 12, further comprising a series of openings along an axis transverse to a longitudinal axis to permit said latch body member and said latch member to be separated from said receiver body member.

14. A reclosable fastener, as defined in claim 1, where said first surface of said receiver body member and said sixth surface of said latch member are flat.

15. A reclosable fastener, as defined in claim 1, where said first surface of said receiver body member is undulating and said fifth surface of said latch member has corresponding undulations to permit the full engagement of said first surface of said receiver body member with said fifth surface of said latch member.

16. A reclosable fastener, as defined in claim 15, wherein said first fastening member is a first layer of separable pressure-sensitive adhesive along the undulating first surface of said receiver body member and said second fastening member is a second layer of separable pressure-sensitive adhesive along the undulating fifth surface of said latch member.

* * * * *